US006584731B2

(12) United States Patent
Arquevaux et al.

(10) Patent No.: US 6,584,731 B2
(45) Date of Patent: Jul. 1, 2003

(54) VEHICLE WINDOW LIFTER WITH CABLE TENSIONING DEVICE

(75) Inventors: Laurent Arquevaux, Sully sur Loire (FR); Pascal DeVries, Sandillion (FR); David Lewicki, Baule (FR); Jacky Mercier, Bonnee (FR); Hong Vu Nguyen, Orleans (FR)

(73) Assignee: Meritor Light Vehicle Systems-France, Sully-sur-Loire (FR)

( * ) Notice: Subject to any disclaimer, the term of this patent is extended or adjusted under 35 U.S.C. 154(b) by 0 days.

(21) Appl. No.: 10/084,599

(22) Filed: Feb. 27, 2002

(65) Prior Publication Data

US 2002/0139051 A1 Oct. 3, 2002

(30) Foreign Application Priority Data

Mar. 19, 2001 (FR) ..... 01 03669

(51) Int. Cl.[7] ..... E05F 11/48
(52) U.S. Cl. ..... 49/352
(58) Field of Search ..... 49/348, 349, 352, 49/502

(56) References Cited

U.S. PATENT DOCUMENTS 4,306,378 A 12/1981 Fukura et al.
5,477,641 A * 12/1995 Heckel et al. ..... 49/28
5,657,580 A * 8/1997 Kobrehel ..... 49/352
5,740,630 A 4/1998 Medebach
5,778,600 A * 7/1998 Chu ..... 49/352

FOREIGN PATENT DOCUMENTS

DE 28 02 563 A 7/1979
DE 32 01 098 A 7/1983
WO WO95 00734 A 1/1995

OTHER PUBLICATIONS

French Search Report dated Oct. 26, 2001.

* cited by examiner

*Primary Examiner*—Jerry Redman

(57) ABSTRACT

A window lifter comprises a cable, a window linkage driven by the cable, a fixed device and a cable redirecting device. The cable redirecting device is rotatably mounted on the fixed device and adapted to automatically lock onto the fixed device upon reaching a predetermined angular position. In addition, the cable redirecting device has a cable guiding portion which is not a figure of revolution about the axis of rotation relative to the fixed device. This window lifting mechanism provides a simple structure with few elements. Its assembly is also simple: the cable-redirecting device is rotatably mounted on the fixed device; it is thereafter rotated for tensioning the cable and then locked in a position where the cable is tensioned.

24 Claims, 10 Drawing Sheets

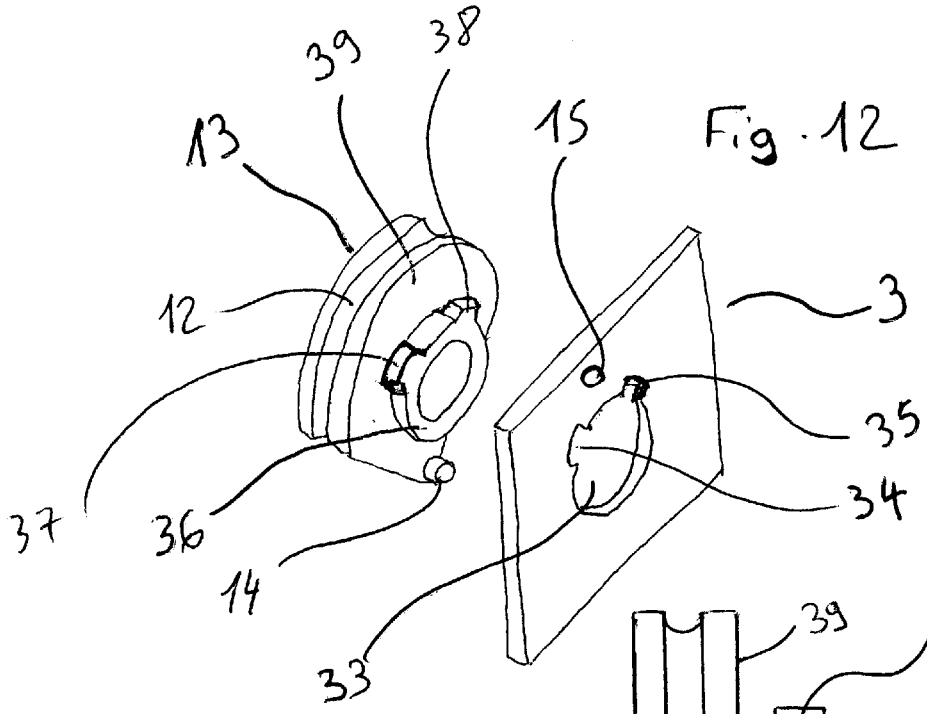
Fig. 12
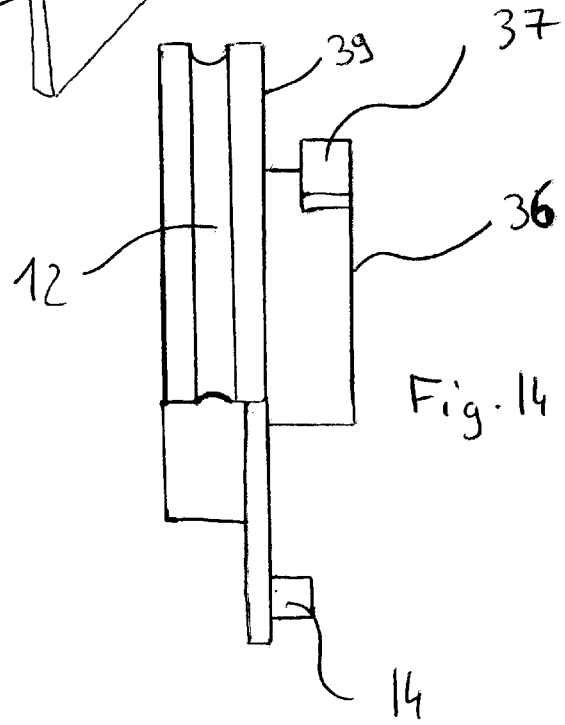
Fig. 14
Fig. 13
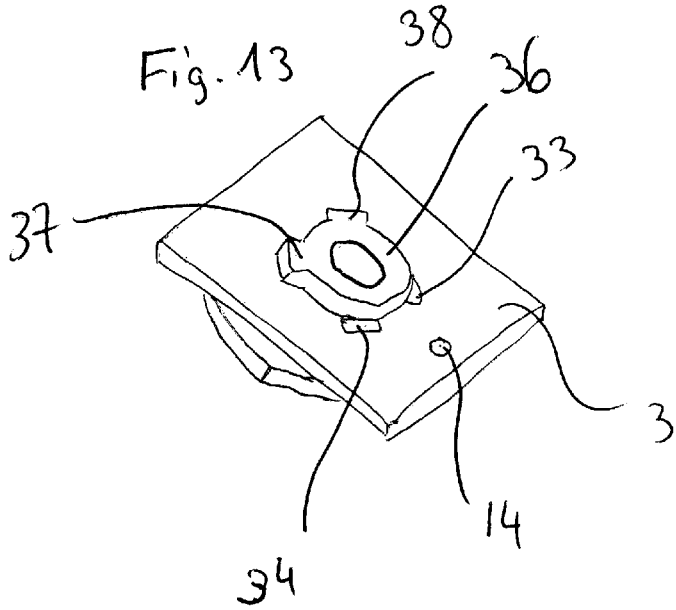

VEHICLE WINDOW LIFTER WITH CABLE TENSIONING DEVICE

This application claims priority to French patent application FR 01 03 669 filed Mar. 19, 2001.

BACKGROUND OF THE INVENTION

The invention concerns a vehicle window lifter mechanism, and more particularly a window lifter comprising a cable tensioning device.

Document DE-A-32 01 098 discloses a window lifter mechanism. This window lifter mechanism comprises a guide rail, a slider supporting a window glass and slidably mounted on the guide rail, cable redirection means provided at each end of the guide rail and a winding drum linked to the slider by at one cable passing over the cable redirection means. This type of window lifter is currently used in the automobile industry. A cable-winding drum is driven in rotation either by a handle, or by a motor and speed reduction gear to raise and lower the vehicle window. During this operation, one of the cables is wound onto the drum while the other cable is unwinding. In operation, the cable is kept tensioned to reduce angular play at the handle or speed reduction gear when changing the sense of movement of the window, and to prevent the cables escaping from the guide channels.

The redirection means carry a channel. The channel is a figure of revolution about a geometrical axis X, and a cable run slides in this channel. The redirection means comprises a supporting element, a redirection ring and a helical spring located between the supporting element and the redirection ring. The helical spring exerts a cable stretching effort on the redirection means. The redirection ring comprises an axis of symmetry. The supporting element comprises a shaft that is firstly rotatably mounted on a retention plate. This shaft and the redirection ring are offset. The supporting element is rotated in order to stretch the cable. Once a desired cable stretching is obtained, the shaft is riveted to the retention plate.

This window lifter has several drawbacks. Among them, the use of a spring complicates notably the assembly of the window lifting mechanism.

Document WO-A-95 00734 describes another window lifting mechanism. This window lifting mechanism comprises a cable guide member rotatably mounted to a body. The guide member seats and guides a cable. A spring biases the guide member in a rotational direction in order to tension the cable. The window lifting mechanism also comprises ratchet means coupling the cable guide member and the body. The ratchet means are responsive to a very slow change in the operating rotational position of the guide member in one rotational direction, over multiple cyclic movements of the line, to move from one ratchet position to a next ratchet position comprise an engagement member.

This window lifter has several drawbacks. Among these drawbacks, this window lifting mechanism does not lock the guide member on the body. Indeed, the guide member is able to move during a window movement, which can cause noise.

Both window-lifting mechanisms require complex and expensive elements. These window-lifting mechanisms also require complicated and tedious assembly.

There is a need for a window lifter that solves one or several drawbacks of this window lifter.

SUMMARY OF THE INVENTION

An object of the present invention concerns a window lifter comprising:

a cable;

a window linkage driven by the cable;

a fixed device;

a cable redirecting device:

rotatably mounted on the fixed device;

adapted to automatically lock onto the fixed device upon reaching a predetermined angular position;

having a cable guiding portion (12) which is not a figure of revolution about the axis of rotation relative to the fixed device.

According to another aspect of the invention, the cable-redirecting device is adapted to be elastically deformed before reaching the predetermined position.

According to a further aspect of the invention, the fixed part provides a protruding portion, elastically biasing the cable-redirecting device before the redirecting device reaches the predetermined position.

According to a still further aspect of the invention, the protruding portion is formed by stamping or deep drawing of the fixed device.

According to another aspect of the invention, the protruding portion is a slanted ramp.

In another embodiment, the fixed device provides an aperture, the cable redirecting device includes a lug adapted to be housed in the aperture.

According to a further aspect of the invention, the fixed device comprises a plurality of apertures adapted to house said lug.

In another embodiment, the redirecting device is rotatably mounted on a shaft integral with the fixed device.

In a further aspect of the invention, the shaft is formed by stamping or deep drawing of the fixed device.

In another embodiment of the invention, the fixed device provides a cut-out, the cable-redirecting device provides a protrusion, the cut-out (33) and the protrusion being shaped to allow the insertion of the protrusion through the cut-out in a predetermined relative angular position and to provide rotation guiding to the inserted protrusion for other relative angular positions.

According to a further aspect of the invention, the protrusion provides a cylindrical portion, a radially-oriented pin, located at the distal end of the cylindrical portion.

According to an aspect of the invention, the window lifter further comprises a rail on which the window linkage is slidably mounted.

In another aspect of the invention, the cable-redirecting device carries a channel which is substantially a figure of revolution and in which a cable run slides.

In an aspect of the invention, the cable-redirecting device has the form of a sector of a circle.

BRIEF DESCRIPTION OF THE DRAWINGS

Further advantages and characteristics of the invention will become clearer from the description that follows, provided by way of non limiting examples, with reference to the attached drawings in which:

FIG. 12 shows an exploded view of another embodiment of a redirecting cable device according to the invention;

FIG. 13 shows a perspective view of the assembled redirecting cable device shown at FIG. 12;

FIG. 14 shows a side view of an element of the redirecting cable device shown at FIGS. 12 and 13;

DETAILED DESCRIPTION OF THE INVENTION

Figure 1:
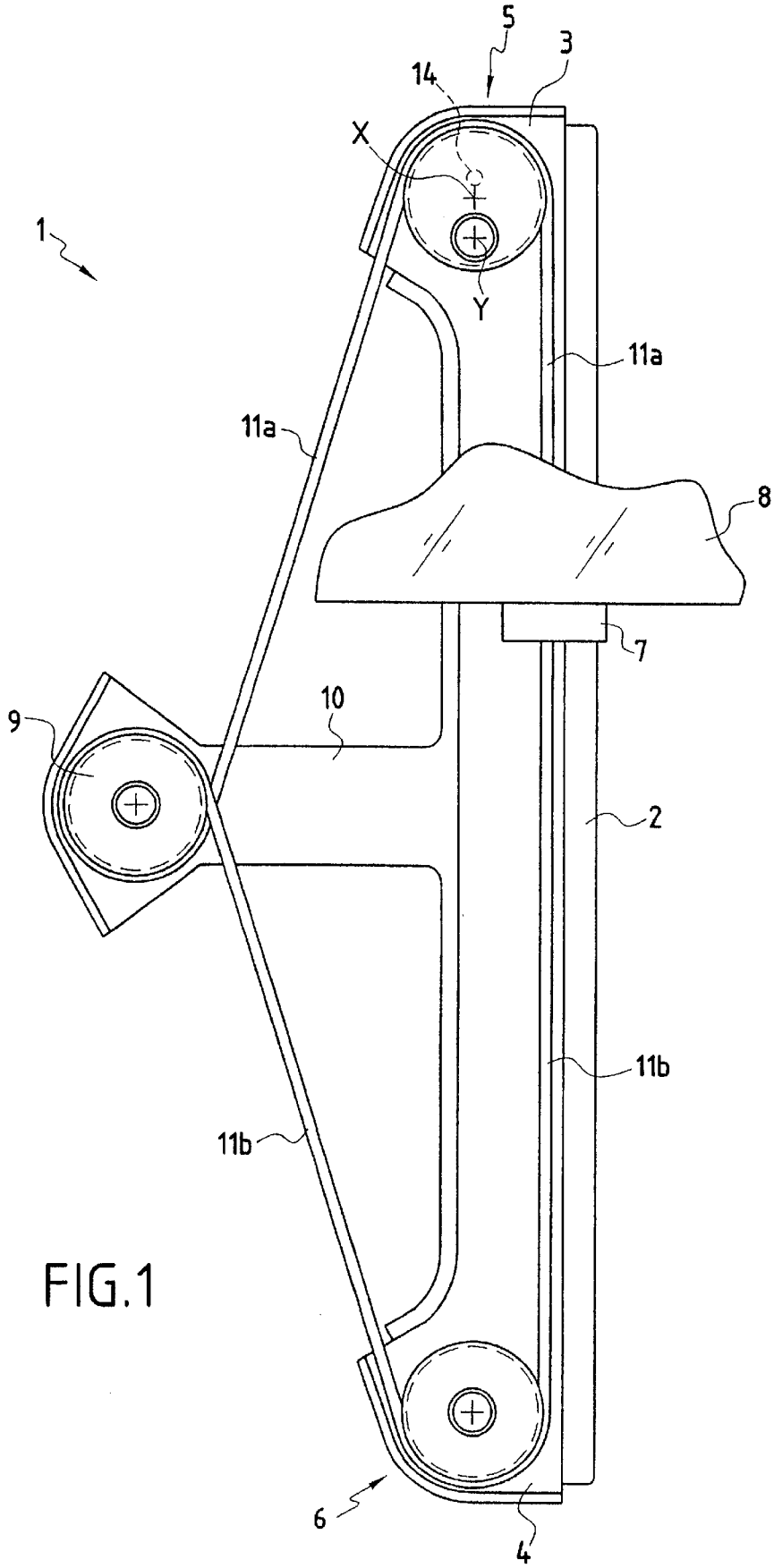
FIG. 1 is a diagrammatic side view of a cable-driven window lifting mechanism according to the invention.

FIG. 1 shows a cable-driven window lifting mechanism 1 which includes a guide rail 2 terminating at each end with plates 3 and 4 onto which means, 5 and 6, for redirecting a cable are provided. A window linkage 7 supports a vehicle window 8. This window linkage 7 is built as a slider in the example, since it is slidingly mounted along the guide rail 2. This slider 7 is connected to a winding drum 9 via two cables 11*a* and 11*b* which respectively pass over the cable redirecting means 5 and 6. The winding drum is located on an arm 10 integral with rail 2. Winding drum 9 is rotated either by a handle, or by a motor and speed reduction gear, not shown in the drawings, which causes slider 7 to move along guide rail 2. When the window lifting mechanism 1 is mounted on a vehicle structure, on a door for example, movement of slider 7 causes the window 8 to move up or down.

Though the embodiments described thereafter comprise a guide rail 2, a window lifting mechanism according to the invention can also be built without using a guide rail. Window lifting mechanisms without rails are structures known per se. Appropriate window linkages for these window-lifting mechanisms are also known per se.

Figure 2:
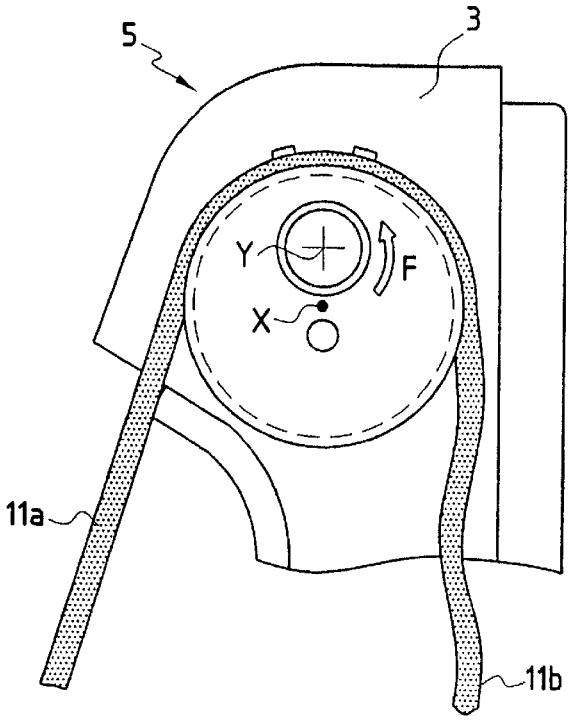
FIG. 2 shows the initial position of the member including the guide channel for a cable run while the window lifting mechanism is being assembled.
Figure 3:
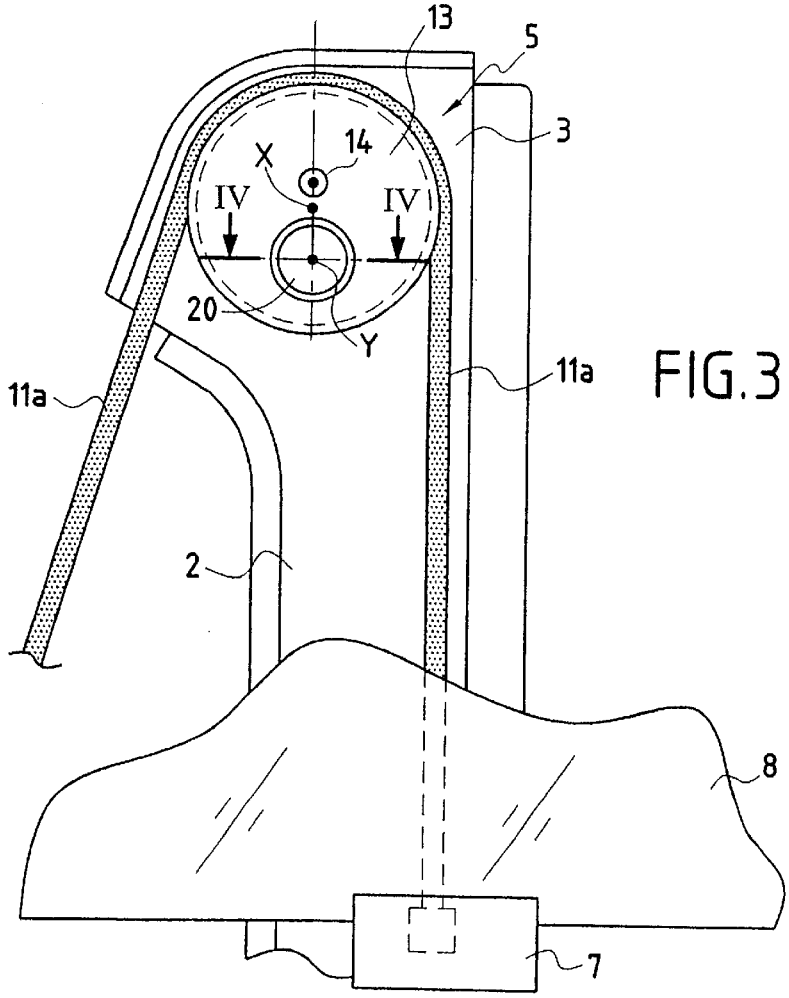
FIG. 3 shows the final position of the same member, providing cable tensioning.

FIGS. 2 and 3 show a first embodiment according to the invention. At least one of the redirecting means 5 or 6, the upper redirecting means 5 for example, includes a channel 12 which is a figure of revolution about an axis X. The channel is provided for instance at the periphery of a circular member 13 mounted on the upper end plate 3 so that it can rotate, when the window lifting mechanism 1 is being mounted, about an axis Y which is offset with respect to the axis of revolution X.

FIG. 2 shows the initial position of member 13 before the cable is tensioned. Cable run 11*a* is placed in the peripheral channel 12 of member 13. In this position, the axis of revolution X of channel 12, which is located at the center of member 13, is located below axis Y. In this initial position, cable run 11*a* is untensioned.

To stretch the cable, member 13 is rotated about its axis of rotation Y, in the clockwise sense or anti-clockwise sense, for moving the axis of rotation X about the axis of rotation Y along a circular path indicated by arrow F on FIG. 2. This movement creates the tension in upper cable run 11*a*.

Generally, in order to ensure a cable tensioning effect during the rotation of the cable redirecting device, the cable redirecting device comprises a cable guiding portion 12 with the following feature: the form of the cable guiding portion 12 used is not a figure of revolution about the axis of rotation Y of the cable redirecting device 13 relative to the fixed device.

When the member 13 reaches its final position shown in FIG. 3, the member 13 is locked with respect to plate 3. The cable is tensioned when the member is locked at this position.

Figure 5:
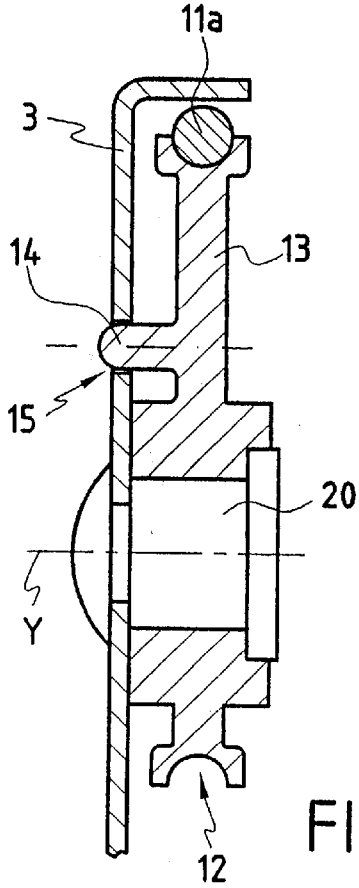
FIG. 5, shows another system immobilising the member with respect to the guide rail.

This can be done by snap-in insertion of a lug 14 formed on member 13 facing plate 3, into an aperture 15 provided in plate 3, as illustrated on FIG. 5. In this example, a shaft 20 sets the cable-redirecting device 13 in rotation relative to the end plate. Upon rotation of the cable-redirecting device 13, the lug 14 enters the aperture 15 at a predetermined angular position. The cable-redirecting device 13 thus automatically locks on the plate 3, with a cable tensioning effect. The cable tensioning and the redirecting device locking are thus particularly simple to operate.

The automatic locking of the redirecting device is obtained as follows: the cable redirecting device 13 is rotatably mounted and the fixed plate 3, but the lug 14 engages the plate 3 during the rotation of the cable redirecting device. The cable-redirecting device is thus elastically deformed before it reaches the predetermined locking position. Since elastic deformation energy is stored in the cable-redirecting device during its rotation, insertion of the lug 14 in the aperture 15 is automatic.

Figure 6:
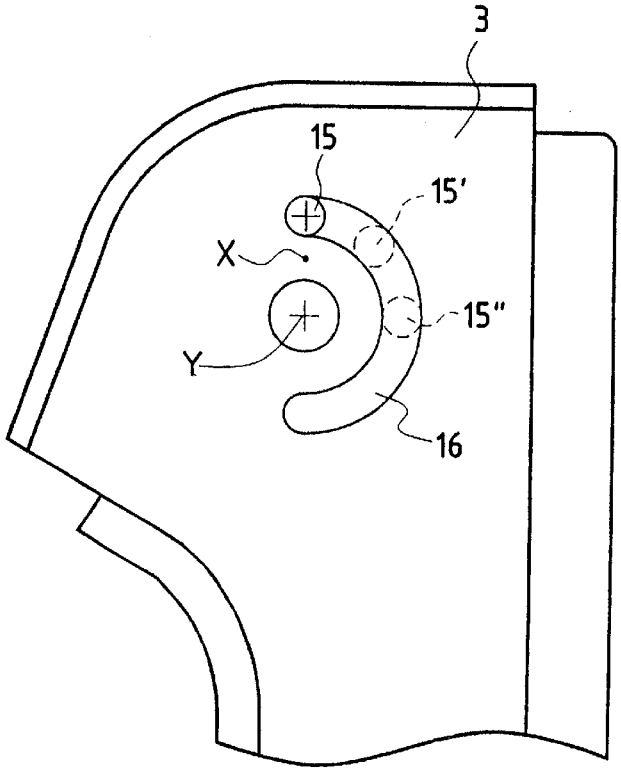
FIG. 6 is a front view of the end of the guide rail.

Reference numeral 16, which can be seen on FIG. 6, shows the path followed by the end of lug 14 when member 13 rotates about axis Y. A plurality of apertures 15, 15', 15" can be provided along path 16. Which of the apertures is to receive lug 14 depends on the degree of tension required for cable run 11*a* and manufacturing tolerances. When the lug automatically enters an aperture, an operator can draw the lug out of this aperture and rotate the cable-redirecting device further, until the lug enters another appropriate aperture.

Obviously, lug 14 can be provided on end plate 3 and the apertures 15, 15', 15" can be provided on the side face of member 13.

Figure 4A:
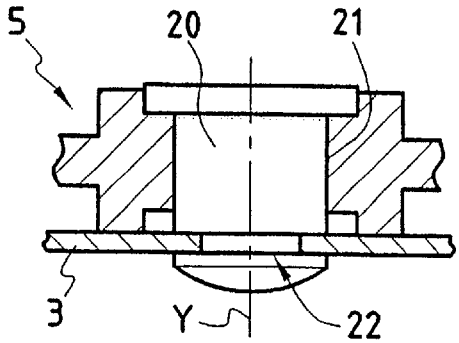
FIGS. 4*a*, 4*b* and 4*c* are cross-sections along line IV—IV of FIG. 3, which shows several alternative embodiments of the mounting system for the member, which allows the member to pivot on the guide rail.
Figure 4B:
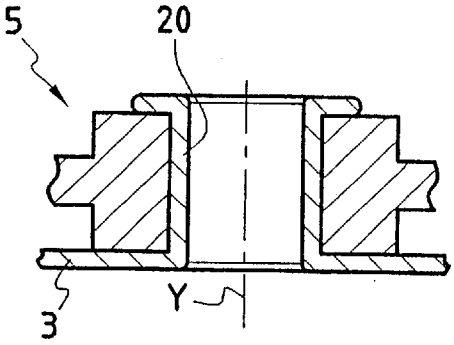
Figure 4C:
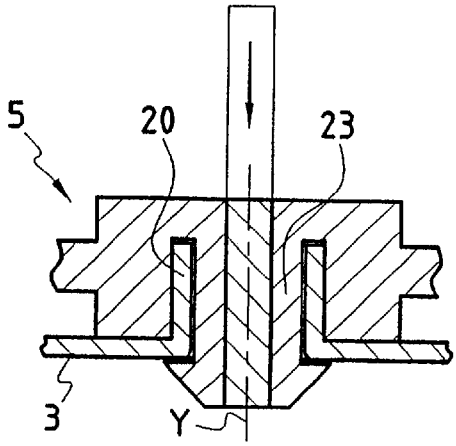

FIGS. 4*a*, 4*b* and 4*c* show three embodiments of a shaft 20 for axis Y, passing through a passage 21 on axis Y, provided in member 13.

On FIG. 4*a*, the shaft 20 consists of a pin secured by riveting in a passage 22 provided in plate 3.

As can be seen on FIG. 4*b*, shaft 20 is hollow and is provided by stamping or deep drawing of plate 3.

FIG. 4*c* also shows a hollow shaft 20 formed by stamping or deep drawing. Member 13 has a central part 23 retained in the inner cavity of a hollow shaft 20 by riveting.

Figure 7:
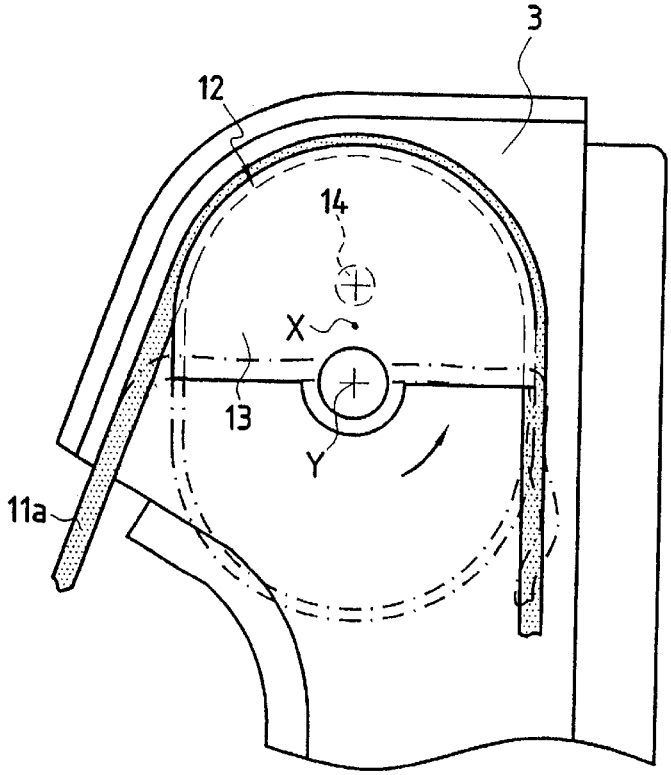
FIG. 7 shows a member in the form of an angular sector.

In the preferred embodiments shown above, member 13 is circular. FIG. 7 shows a member 13' in the form of a sector of a circle with center X, able to pivot about an eccentric axis Y. This member 13' can, in some applications, replace circular member 13. A member 13' in the form of a sector of circle uses less material than a circular member 13.

Figure 8:
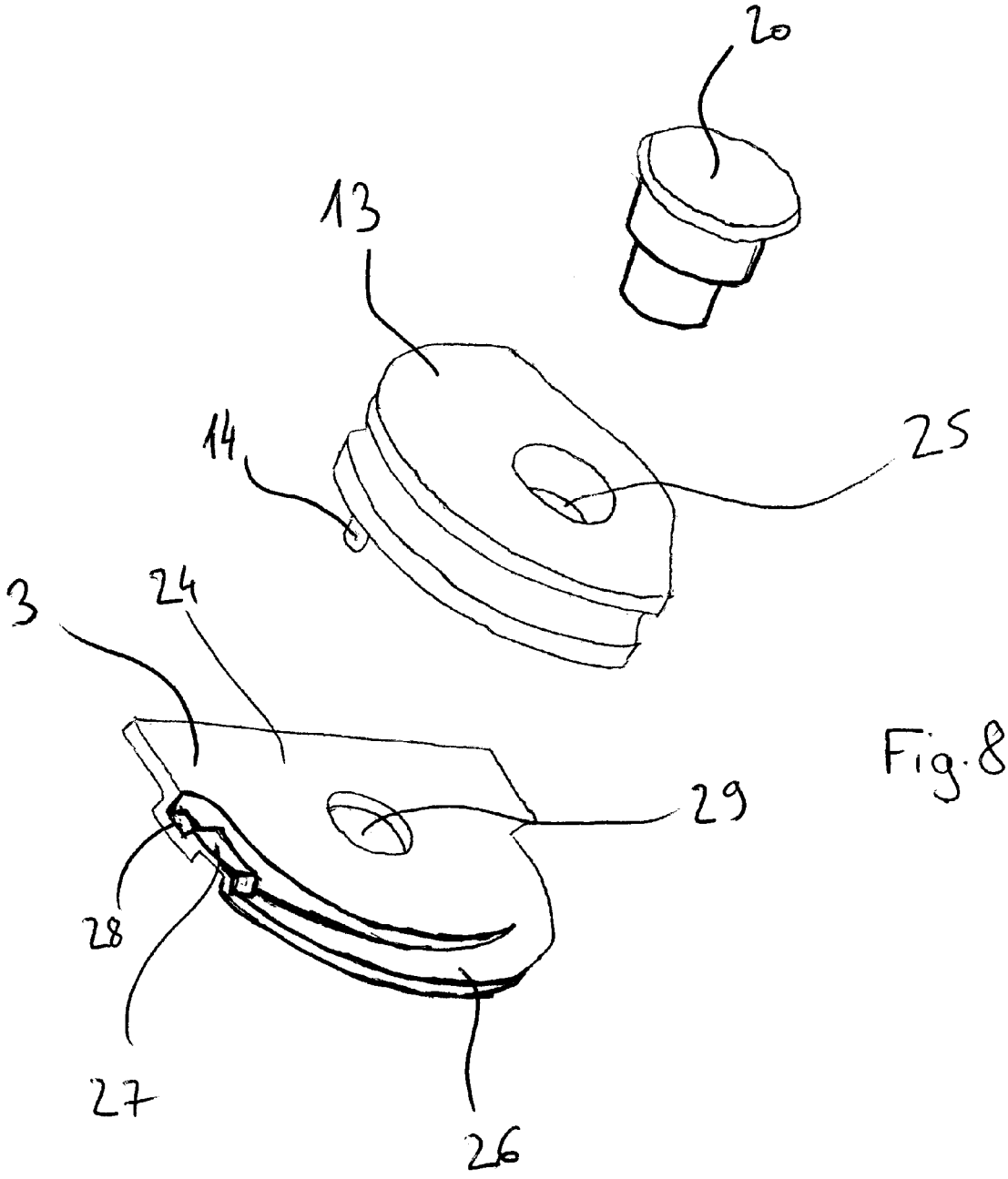
FIG. 8 shows an exploded view of another embodiment of a redirecting cable device according to the invention.

FIG. 8 shows an exploded view of another embodiment of the invention. The cable-redirecting device 13 provides a structure close to that disclosed in FIG. 7. This cable-redirecting device 13 provides a through hole 25 in order to let shaft 20 pass through. This cable-redirecting device 13 provides a lug 14 on one of its faces.

The plate 3 provides a plane portion 24 for reception of the cable-redirecting device 13. The plate 3 also provides a lug-guiding track 26. This lug guiding track 26 ends on a step 27. A recess 28 is provided behind the step 27. The plate 3 also has through hole 29, serving as a reception hole for shaft 20. The shaft 20 can be fixed on plate 3 to maintain the cable-redirecting device by any appropriate means. A possible solution is for example to use matching threads provided on shaft 20 and hole 29.

Figure 9:
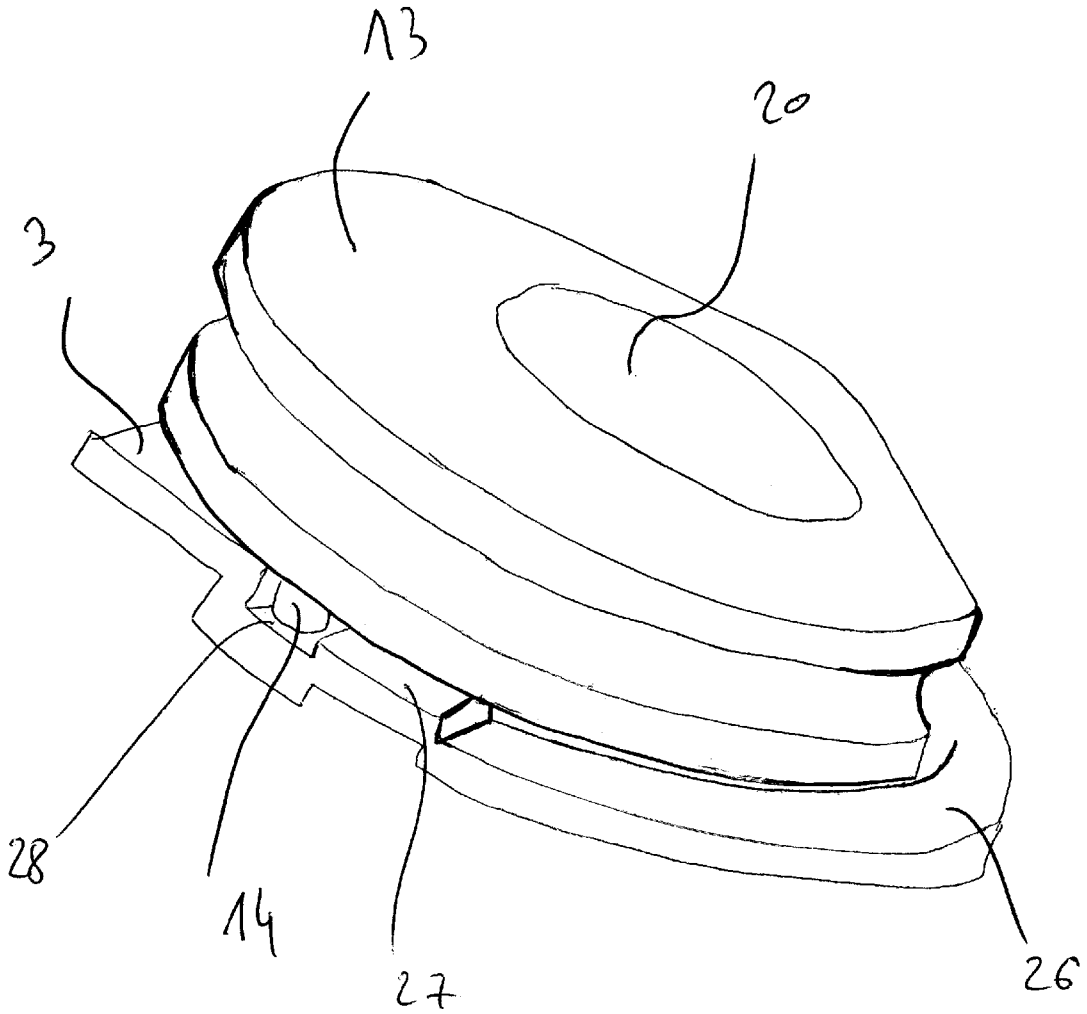
FIG. 9 shows a perspective view of the assembled redirecting cable device shown at FIG. 8.

When the cable-redirecting device 13 is rotatably mounted on plate 3, the lug 14 is engaged on the guiding track 26. A rotation of the cable-redirecting device 13 engages the lug 14 against step 27. A further rotation of the cable-redirecting device 13 leads the lug to step on step 27. Either the cable redirecting device 13 or the shaft 20 are elastically deformed. Upon a further rotation of the cable-redirecting device 13, the lug 14 automatically enters the recess 28 due to the elastic deformation. The cable-redirecting device 13 is thus locked on plate 3 in the position shown at FIG. 9.

Figure 10:
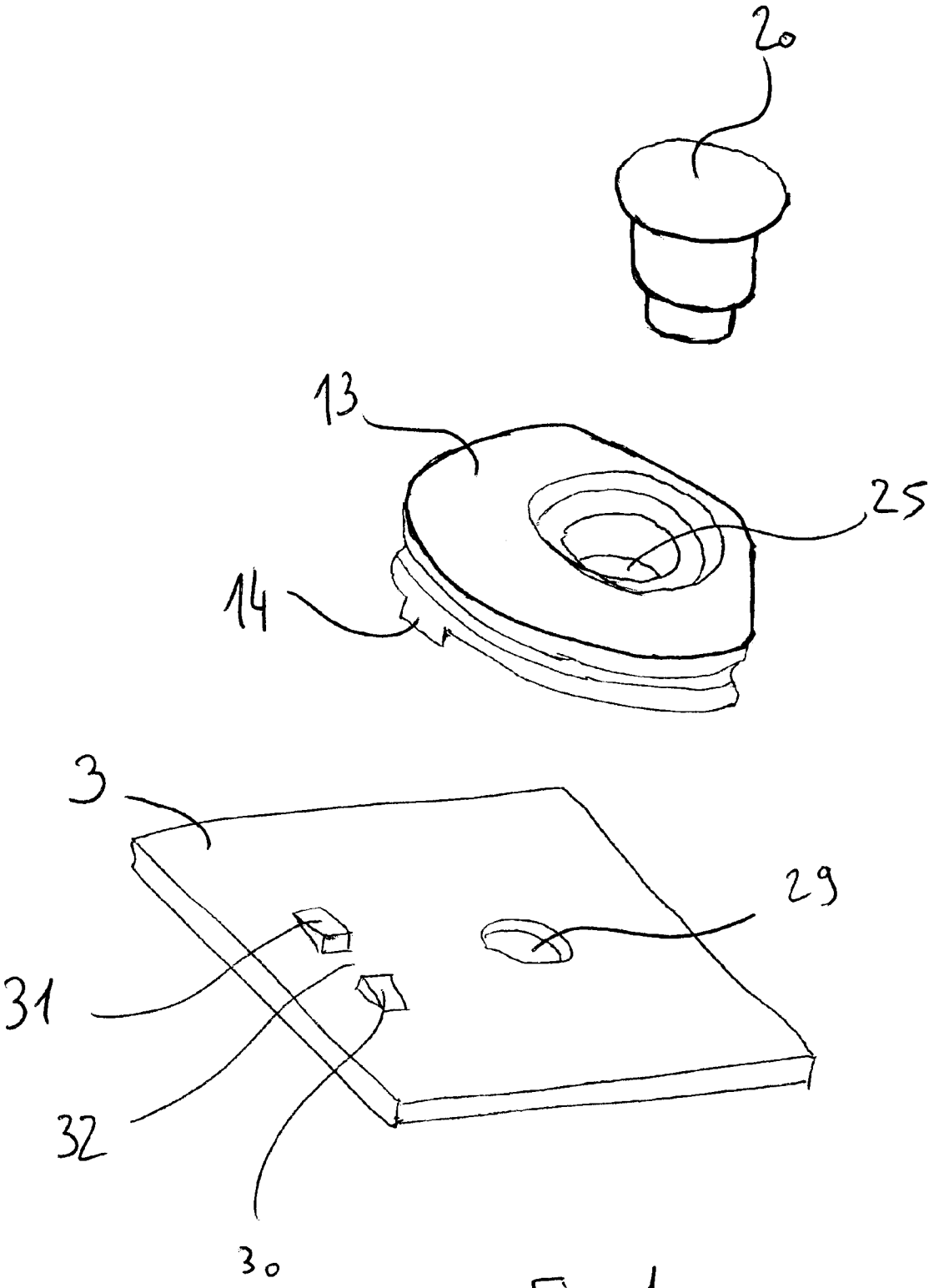
FIG. 10 shows an exploded view of another embodiment of a redirecting cable device according to the invention.

FIG. 10 shows an exploded view of another embodiment of the invention. In this embodiment, a shaft 20 is used for mounting the cable-redirecting device 13 rotatably on plate 3, as was described previously. The cable-redirecting device 13 provides a lug 14 on one of its faces.

Figure 11:
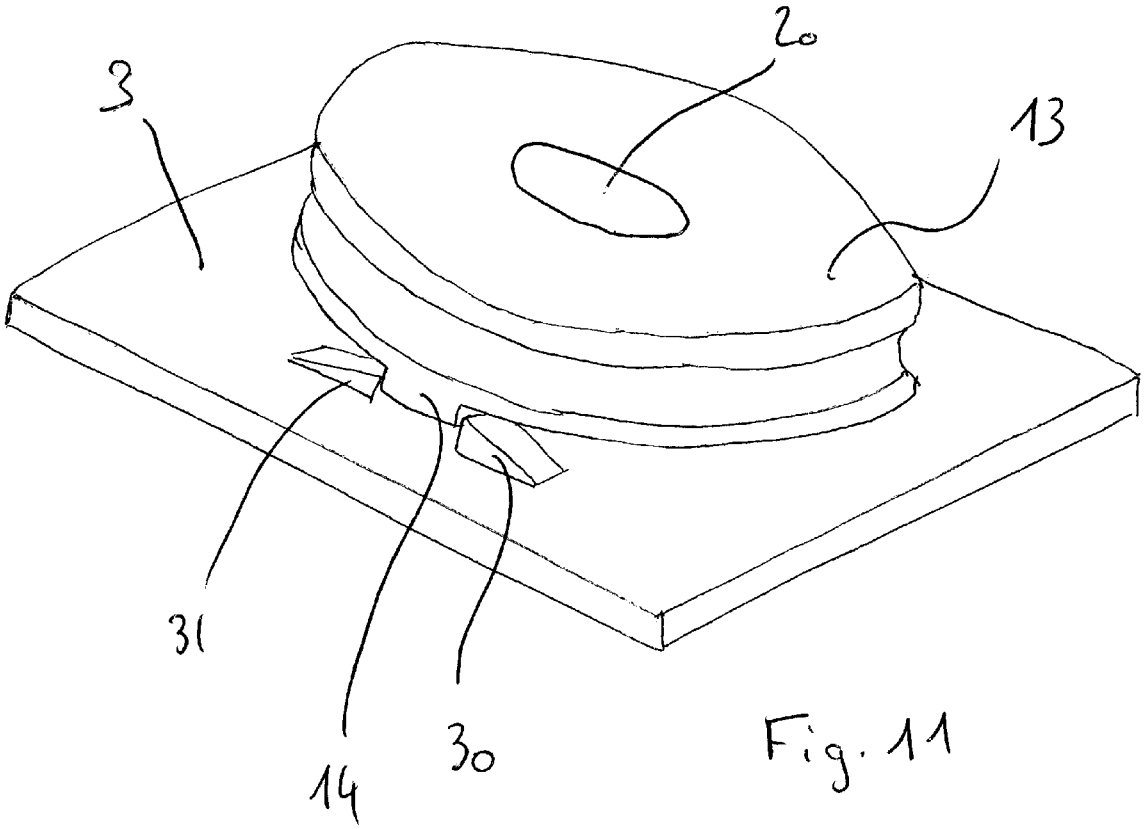
FIG. 11 shows a perspective view of the assembled redirecting cable device shown at FIG. 10.

Plate 3 provides on one of its faces two opposite protruding slanted ramps 30 and 31. These ramps define a recess 32 between them. When the cable-redirecting device 13 is rotatably mounted on plate 3, the lug 14 is engaged on the plate 3. A rotation of the cable-redirecting device 13 engages the lug 14 against either slanted ramp 30 or slanted ramp 31. A further rotation of the cable-redirecting device 13 leads the lug to step on a ramp. Due to the slant, either the shaft or the cable-redirecting device is progressively elastically deformed. Upon a further rotation of the cable-redirecting device 13, the lug 14 automatically reaches the end of the ramp and enters the recess 32. The cable-redirecting device 13 is thus locked on plate 3 in the position shown at FIG. 11.

Though two ramps were used in this example, one could also use only one ramp. One could for example use one ramp and one abutment to define a locking recess.

The protruding ramp or abutment is preferably formed by stamping or deep drawing of a fixed metallic device. Different features of the fixed device or plate 3 can thus be formed in a single manufacturing step. Generally, a protruding portion designed for biasing the cable-redirecting device can be formed by stamping or deep drawing on any kind of appropriate plate 3.

FIG. 12 represents a perspective view of still another embodiment of the invention before its assembly. A cable redirecting device 13 and a plate 3 are in position for the start of their assembly.

The plate 3 provides an aperture 15 conformed for the insertion of a lug 14 provided on the cable-redirecting device. The aperture and the lug have the mutual locking function described in the first embodiment. The plate also provides a cut-out 33 offset with respect to the aperture 15. The edge of the cut-out 33 has basically a circular portion interrupted by two notches 34 and 35.

Figure 15:
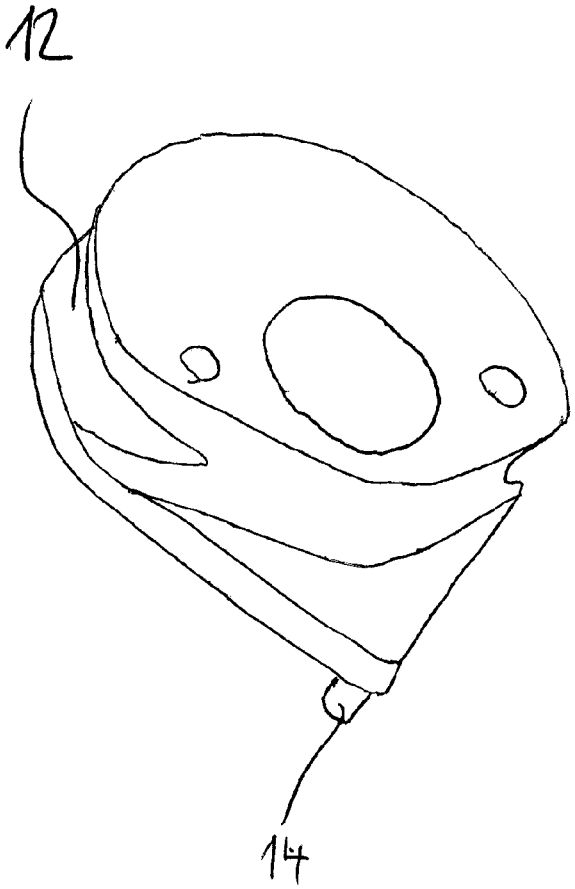
FIGS. 15 and 16 show perspective views of the element shown at FIG. 14.
Figure 16:
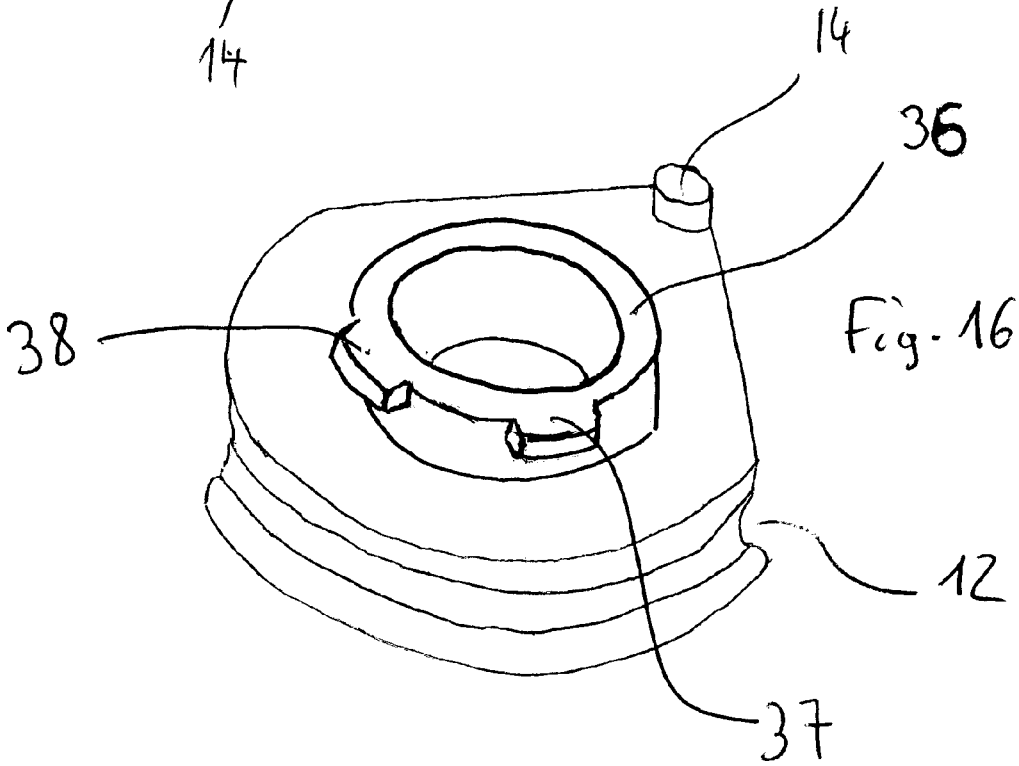

FIGS. 14 to 16 provide a detailed representation of an example of cable redirecting device designed to match this plate 3. The cable-redirecting device 13 provides a cable-guiding channel 12 known per se. The cable-redirecting device 13 also provides a protrusion 36 on one of its faces. This protrusion mainly has a cylindrical portion. The protrusion 36 provides two radially extending pins 37 and 38, located at the distal end of the cylindrical portion.

The cut-out 33 and the protrusion 36 are shaped to allow the insertion of the protrusion through the cut-out for the predetermined relative angular position shown at FIG. 12. In the example, pins 37 and 38 are designed to pass through notches 34 and 35. One could also shape the cut-out 33 and the protrusion 36 in order to obtain more relative angular positions for insertion.

The cable-redirecting device 13 provides a recess delimited by pins 37 and 38 on one side and by a flange 39 on the other side. Once the protrusion 36 is inserted through the cut-out 33, a rotation of the cable redirecting device provides a rotative connection between the cable redirecting device and the plate. Indeed, the plate engages in the recess of the cable-redirecting device and is therefore maintained in translation by pins 36 and 37 on one side and by the flange 39 on the other side. The circular portion of the cut-out edge provides rotation guiding to the cylindrical portion of the protrusion.

The cable redirecting device 13 is preferably designed so that the lug's height is greater than the distance between the plate 3 and the flange 39 of the mounted cable-redirecting device. Thus, rotation of the cable-redirecting device 13 after the insertion of the protrusion 36 through the cut-out 33 generates an elastic deformation, either from the cable redirecting device or from the plate 3.

The lug is preferably located on a portion of the cable-redirecting device that presents a smaller cross-section. Thus, this portion has a higher flexibility than the overall cable-redirecting device. This flexible portion is thus able to store deformation energy used for the automatic locking of lug 14 in aperture 15. Upon a sufficient rotation of the cable-redirecting device, the lug thus enters the aperture.

The relative position of the cable-redirecting device and the plate is that shown at FIG. 13. This embodiment provides particularly simple assembly: an operator only needs to introduce the protrusion through the cut-out and to rotate the cable redirecting device. A cable introduced in the cable-guiding channel 12 is then tensioned by these two basic operations. Moreover this embodiment provides a particularly simple structure of cable redirecting and tensioning device. This device does not need an additional shaft for its guidance relative to the plate.

Any of the window lifters described previously preferably comprises an additional cable-tensioning device. Such a cable-tensioning device, such as a leaf spring biasing the cable, is known per se and can be adapted appropriately by the man skilled in the art. This additional cable-tensioning device compensates the wear of the window lifter. It guarantees that the cable undergoes a sufficient tension even after several years of use.

Other modifications and variations within the scope of the invention, which is defined by the appended claims, will be apparent to those of skill in the art.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A window lifter comprising:

a cable;

a window linkage driven by the cable;

a fixed device including one of an aperture and a projection; and a cable redirecting device including the other of the aperture and the projection and rotatably mounted on the fixed device and to automatically lock onto the fixed device upon reaching a predetermined angular position by entry of the projection in the aperture, and the cable redirecting device has a cable guiding portion with an axis of revolution different from an axis of rotation of the cable redirecting device, wherein the projection is integrated with one of the fixed device and the cable redirecting device.

2. The window lifter according to claim 1, wherein the cable redirecting device is adapted to be elastically deformed before reaching the predetermined angular position.

3. The window lifter according to claim 2, wherein the fixed device provides a protruding portion elastically biasing the cable redirecting device before the cable redirecting device reaches the predetermined angular position.

4. The window lifter according to claim 3, wherein the protruding portion is formed by stamping of the fixed device.

5. The window lifter according to claim 4, wherein the protruding portion is a slanted ramp.

6. The window lifter according to claim 3, wherein the protruding portion is formed by deep drawing of the fixed device.

7. The window lifter according to claim 3, wherein the protruding portion is a slanted ramp.

8. The window lifter according to claim 1, wherein the fixed device provides the aperture and the cable redirecting device includes the projection adapted to be housed in the aperture.

9. The window lifter according to claim 8, wherein the fixed device comprises a plurality of said apertures adapted to house said lug.

10. The window lifter according to claim 8, wherein the projection is a lug.

11. The window lifter according to claim 1, wherein said redirecting device is rotatably mounted on a shaft integral with the fixed device.

12. The window lifter according to claim 11, wherein the shaft is formed by stamping of the fixed device.

13. The window lifter according to claim 11, wherein the shaft is formed by deep drawing of the fixed device.

14. The window lifter according to claim 1, wherein the fixed device provides a cut-out, the cable redirecting device provides a protrusion, and the cut-out and the protrusion are shaped to allow the insertion of the protrusion through the cut-out and to provide rotation guiding to the protrusion.

15. The window lifter according to claim 14, wherein the protrusion provides a cylindrical portion and at least one radially-oriented pin located at a distal end of the cylindrical portion.

16. The window lifter according to claim 14, wherein the protrusion includes a cylindrical portion having two radially-oriented pins and the cut-out includes two notches.

17. The window lifter according to claim 1, further comprising a rail on which the window linkage is slidably mounted.

18. The window lifter according to claim 1, wherein said cable redirecting device is a channel in which a cable run of the cable slides.

19. The window lifter according to claim 18, wherein the cable redirecting device is a sector of a circle.

20. The window lifter according to claim 18, said channel provides the axis of revolution.

21. The window lifter according to claim 1, wherein the cable is tensioned when the cable redirecting device is in the predetermined angular position.

22. The window lifter according to claim 1, wherein the fixed device provides a slanted ramp, said aperture and a step therebetween, and said slanted ramp declines towards said step, and said cable redirecting device provides the projection.

23. The window lifter according to claim 1, wherein the fixed device provides two opposing slanted ramps with the aperture therebetween, and said cable redirecting device provides the projection.

24. The window lifter according to claim 1, wherein the cable redirecting device is circular.

* * * * *

UNITED STATES PATENT AND TRADEMARK OFFICE

CERTIFICATE OF CORRECTION

PATENT NO. : 6,584,731 B2 
DATED : July 1, 2003
INVENTOR(S) : Laurent Arquevaux et al.

It is certified that error appears in the above-identified patent and that said Letters Patent is hereby corrected as shown below:

Column 8,
Line 29, please insert -- wherein -- before "said"

Signed and Sealed this

Sixteenth Day of September, 2003

JAMES E. ROGAN
*Director of the United States Patent and Trademark Office*